United States Patent [19]

Ringbloom

[11] 4,357,185

[45] Nov. 2, 1982

[54] PROCESS FOR COATING CRYSTALLINE EXPLOSIVES WITH POLYETHYLENE WAX

[75] Inventor: Vernon D. Ringbloom, West Friendship, Md.

[73] Assignee: The United States of America as represented by the Secretary of the Navy, Washington, D.C.

[21] Appl. No.: 265,300

[22] Filed: May 20, 1981

[51] Int. Cl.[3] ..... C06B 45/32

[52] U.S. Cl. ..... 149/6; 149/11; 149/92

[58] Field of Search ..... 149/6, 11, 92

[56] References Cited

U.S. PATENT DOCUMENTS

| | | | |
|---|---|---|---|
| 3,544,360 | 12/1970 | Gardner | 149/11 |
| 3,740,278 | 6/1973 | Sakreis et al. | 149/11 |
| 3,788,906 | 1/1974 | Schroeder | 149/6 |
| 4,043,850 | 8/1977 | Hoffman et al. | 149/19.4 |
| 4,091,729 | 5/1978 | Bell et al. | 102/38 |
| 4,092,187 | 5/1978 | Hildebrant et al. | 149/11 |

*Primary Examiner*—Stephen J. Lechert, Jr.
*Attorney, Agent, or Firm*—R. S. Sciascia; A. L. Branning; R. D. Johnson

[57] ABSTRACT

An improved method of coating crystalline high explosives with polyethylene wax comprising:

(a) forming a loose slurry of finely divided crystalline explosive particles in water;

(b) adding an emulsion of
  (1) an emulsifiable polyethylene wax,
  (2) potassium stearate,
  (3) KOH, and
  (4) water to the slurry;

(c) heating the slurry-emulsion mixture to a temperature in the range of from about 92° C. to about 98° C. with stirring;

(d) adding enough acetic acid to the slurry-emulsion mixture to lower the pH to about 6 with stirring;

(e) cooling the resulting solution; and (f) isolating the product polyethylene wax coated high explosive particles.

4 Claims, No Drawings

PROCESS FOR COATING CRYSTALLINE EXPLOSIVES WITH POLYETHYLENE WAX

BACKGROUND OF THE INVENTION

This invention relates to explosives and more particularly to polymeric wax coated explosives.

Previous methods of coating crystalline high explosives use polyethylene wax emulsified with fatty acids and basic materials such as ammonia and morpholine. The explosive crystals are then slurried in the aqueous emulsion. The emulsion is then broken with a heavy metal salt such as $BaCl_2$ thus freeing the polyethylene particles to coat the explosive crystals. After the particles are coated and the mixing operation is completed, the remaining water is removed and the coated crystals are washed. The effluent water from this process contains $Ba^{++}$ ions which are highly toxic and quite costly to remove. The $Ba^{++}$ ions must be removed before the effluent water can be disposed of in the conventional manner.

SUMMARY OF THE INVENTION

According, an object of this invention is to provide a new method of coating high crystalline explosives with polymeric waxes.

Another object of this invention is to provide a method of coating crystalline high explosives with polymeric waxes without the use of heavy metals.

Yet another object of this invention is to provide a process for coating crystalline high explosives with polymeric waxes in which the effluent waters produced may be discharged into the environment without special treatment.

These and other objects of this invention are accomplished by providing:

A method of coating explosives with polyethylene wax comprising the steps of a. forming a slurry of finely divided crystalline explosive in water;

b. adding polyethylene wax-water emulsion to the slurry wherein the emulsion comprises
   (1) a low molecular weight, emulsifible polyethylene wax having a softening point below 100° C.,
   (2) water, wherein the weight ratio of water to polyethylene wax is from 99:1 to 1:1,
   (3) stearic acid, wherein the weight ratio of stearic acid to polyethylene wax is from 1:5 to 1:6, and
   (4) potassium hydroxide in sufficient amount to adjust the pH of the emulsion to above 9;

c. heating the slurry-emulsion mixture to from about 92° C. to about 98° C. with stirring;

d. adding acetic acid to the solution to adjust the pH to about 6;

e. cooling the mixture; and f. isolating the product polyethylene wax coated explosive crystals.

DESCRIPTION OF THE PREFERRED EMBODIMENT

The emulsions used in the present process are composed of a polyethylene wax, potassium stearate as an emulsifier, KOH, and water. The waxes used are low molecular weight, emulsifiable polyethylene waxes which soften at temperatures of less than 100° C. They are soft, pressable polyethylene waxes. Examples of suitable waxes are sold by Allied Chemical Company under the trademark AC-656 TM and by Eastman Chemical Company under the trademark Empolene 110 TM.

The ratio of water to polyethylene wax in the final emulsion may be from about 99:1 to 1:1. In other words, the weight percentage of polyethylene wax based on the weight of the wax plus water is from about 1.0 to 50.0. The higher percentages of wax make transportation and storage more convenient. A 1:1 ratio of water to wax (i.e., 50 weight percent wax) works well; however, it is possible that emulsions having much greater polyethylene wax contents would be difficult to dilute with water as requiring later in the process. Emulsions with low percentages of wax are used when a thinner coating of wax is desired. For most purposes a weight percent of from 10 to 30 is preferred, with 15 to 25 being more preferred. In other words, a weight ratio of water to polyethylene wax of from 9:1 to 2.33:1 is preferred, with from 5.67:1 to 3:1 being more preferred.

The emulsifier used is preferably potassium stearate. Generally, stearic acid is added to the mixture and KOH is used to convert it to potassium stearate. The weight ratio of stearic acid to polyethylene wax is preferably in the range of from 1:5 to 1:6, though this may be varied some. Potassium hydroxide is used in an amount sufficient to convert the stearic acid to potassium stearate and to produce a pH of at least 9, preferably of from 9 to 12, in the final emulsion.

Example 1 illustrates a method by which the emulsions can be prepared from the polyethylene wax, stearic acid, KOH, and water. The resulting emulsions can be stored indefinitely provided that (1) they are not frozen, (2) they are not contaminated by heavy metal salts, and (3) they are not allowed to evaporate.

The coating process is as follows:

(1) A measured quantity of the finally divided crystalline explosive is placed in a stirring vessel equipped with a jacket for both heating and cooling.

(2) Enough water is added to achieve a loose easily stirrable slurry.

(3) An appropriate amount of polyethylene/water emulsion is added to give the desired level of coating on the crystals, and the vessel is heated to just below the boiling point of water (1 atm) while the mixture is stirred. The preferred temperature range is from 92° C. to 98° C.

(4) After reaching the desired temperature enough dilute acetic acid is added to drop the pH to about 6 while stirring vigorously.

(5) The mass is allowed to cool down and the remaining water is decanted off.

(6) The resulting polyethylene coated explosive crystals are then washed with water to remove any residual acetic acid and dried for shipment or storage.

In step (3) the appropriate amount or volume of emulsion used depends on (a) the polyethylene wax concentration in the solution, (b) the quantity of explosive to be coated, and (c) the desired weight percentage of wax in the final product. For purposes of calculation, it is assumed that no significant amount of the wax remains in solution when the pH is 6. The calculations are straight forward. Based on the weight of explosive and the composition of the final product, the amount of wax needed is calculated. Then from this needed weight of wax and the weight percent of wax in the emulsion, the amount of emulsion to be used is calculated.

In step (4) the slurry must be stirred vigorously so that all of the explosive particles are in suspension as uniformly as possible throughout the solution. This is necessary so that a uniform coating of wax on the explosive particles is achieved.

To more clearly illustrate this invention, the following examples are presented. It should be understood, however, that these examples are presented merely as a means of illustration and are not intended to limit the scope of the invention in anyway.

EXAMPLE 1

Preparation of the Emulsion 657 gms emulsifiable polyethylene (Allied Chemicals AC-656 TM) 115 gms stearic acid, 41 gms potassium hydroxide, and 670 gms water were placed in a high pressure reaction vessel and heated until the pressure reached about 10 atmospheres (about 160° C.). The mixture was stirred vigorously while the heat and pressure built up. On attaining about 10 atm. pressure, approximately 2500 ml water which had been preheated to about 80° C. was injected into the reaction vessel. The temperature was raised to 200° C. while the mixture was constantly agitated. The reactor was allowed to cool to about 50° C. and the resulting polyethylene/potassium stearate/water emulsion was drawn off.

EXAMPLE 2

Coating of the Explosives

The emulsion prepared in Example 1 was used to coat cyclotrimethylenetrinitramine (Class "A" RDX). A measured quantity of the finely divided crystalline explosive (Class "A" RDX) was placed in a stirring vessel equipped with a jacket for both heating and cooling. Enough water was added to achieve a loose easily stirrable slurry. Enough of the polyethylene wax/water emulsion was added to give a final explosive composition of 91 weight percent of RDX and 9 weight percent of the polyethylene wax. The vessel was heated to 92°–98° C. with stirring. While the mixture was maintained in this temperature range and was vigorously stirred, dilute acetic acid was added until the pH of the solution was lowered to 6. The mixture was allowed to cool down to 50° C. and the water phase was decanted off. The resulting polyethylene coated explosive crystals were then washed with water to remove any residual acetic acid and dried.

Obviously, many modifications and variations of this invention are possible in the light of the above teachings. It is therefore to be understood that within the scope of the appended claims the invention may be practiced otherwise than as specifically described.

What is claimed as new and desired to be secured by Letters Patent of the United States is:

1. A method of coating explosives with polyethylene wax comprising the steps of a. forming a slurry of finely divided crystalline explosive in water;

b. adding polyethylene wax-water emulsion to the slurry wherein the emulsion comprises (1) a low molecular weight, emulsifible polyethylene wax having a softening point below 100° C., (2) water, wherein the weight ratio of water to polyethylene wax is from 99:1 to 1:1, (3) stearic acid, wherein the weight ratio of stearic acid to polyethylene wax is from 1:5 to 1:6, and (4) potassium hydroxide in sufficient amount to adjust the pH of the emulsion to above 9;

c. heating the slurry-emulsion mixture to from about 92° C. to about 98° C. with stirring;

d. adding acetic acid to the solution to adjust the pH to about 6;

e. cooling the mixture; and f. isolating the product polyethylene wax coated explosive crystals.

2. The process of claim 1 wherein the weight ratio of water to polyethylene wax in the emulsion is from 9:1 to 2.33:1.

3. The process of claim 2 wherein the weight ratio of water to polyethylene wax is from 5.67:1 to 3:1.

4. The process of claim 1, 2, or 3 wherein the pH of the emulsion is from 9 to 12.

* * * * *